US006711883B2

(12) United States Patent
Schwede et al.

(10) Patent No.: US 6,711,883 B2
(45) Date of Patent: Mar. 30, 2004

(54) STRAPPING MACHINE FOR STRAPPING A STACK OF PRODUCTS

(75) Inventors: Roland Schwede, Goldkronach (DE); Roland Vetter, Trebgast (DE)

(73) Assignee: SMB Schwede Maschinenbau GmbH, Goldkronach (DE)

( * ) Notice: Subject to any disclaimer, the term of this patent is extended or adjusted under 35 U.S.C. 154(b) by 0 days.

(21) Appl. No.: 10/255,946

(22) Filed: Sep. 27, 2002

(65) Prior Publication Data

US 2003/0024217 A1 Feb. 6, 2003

Related U.S. Application Data

(63) Continuation-in-part of application No. 09/562,954, filed on May 3, 2000, now abandoned.

(30) Foreign Application Priority Data

May 5, 1999 (DE) ..... 199 20 531
Oct. 8, 1999 (DE) ..... 299 17 881 U
Jan. 31, 2002 (DE) ..... 102 03 903

(51) Int. Cl.[7] ..... B65B 11/00

(52) U.S. Cl. ..... 53/589; 100/7; 100/26; 414/788.1; 414/788.9

(58) Field of Search ..... 53/586, 589, 582, 53/176, 157, 375.6, 201, 209; 100/3, 7, 25, 26; 414/788.1, 788.4, 788.6, 788.9

(56) References Cited

U.S. PATENT DOCUMENTS 3,198,105 A * 8/1965 Smith ..... 100/3
3,225,684 A * 12/1965 Smith ..... 100/4
3,343,334 A * 9/1967 Bode et al. ..... 53/528
4,502,587 A * 3/1985 Clark ..... 198/347.1
4,570,535 A * 2/1986 Higgins et al. ..... 100/7
5,680,813 A * 10/1997 Schwede ..... 100/26
6,120,239 A * 9/2000 Roskam ..... 414/791.2
6,470,655 B1 * 10/2002 Schwede ..... 53/586

FOREIGN PATENT DOCUMENTS

DE 2714543 * 10/1978
DE 2812610 C2 * 10/1978
DE 19503112 A1 * 8/1996
DE 19820668 A1 * 11/1999
EP 0725005 B1 * 1/1996
JP 55052815 A * 4/1980

* cited by examiner

*Primary Examiner*—Stephen F. Gerrity
*Assistant Examiner*—Thanh Truong
(74) *Attorney, Agent, or Firm*—Browdy and Neimark, P.L.L.C.

(57) ABSTRACT

In a strapping machine for strapping a stack of products, in particular a stack of periodicals or the like, by means of a strapping tape, it is provided, with a view to reliable and clean conveyance of the stack of products, in particular in the not yet strapped state, that the conveyor used to advance the stack of products is equipped with guide walls, which flank the stack of products on both sides in the conveyance direction and resemble conveyor belts, and with respective feed plates mounted thereon. The conveyor-belt-type guide walls are mounted on the machine for displacement crosswise of the conveyance direction and can be set moving crosswise of the stack of products by driving means. This transverse motion may be in particular a transverse upsetting motion.

12 Claims, 5 Drawing Sheets

STRAPPING MACHINE FOR STRAPPING A STACK OF PRODUCTS

This is a continuation-in-part of our U.S. patent application Ser. No. 09/562,954 filed May 3, 2000, now abandoned without prejudice in favor of the present application.

BACKGROUND OF THE INVENTION

1. Field of the Invention

The invention relates to a strapping machine for strapping a stack of products, in particular a stack of periodicals or the like, by means of a strapping tape.

2. Background Art

Conventional strapping machines comprise a work table on which a longitudinal and/or cross wrapping device is arranged. These devices are generally provided with a closed tape guide frame into which the stack of products is driven. For longitudinal strapping, it is necessary to remove the guide duct portions of the tape guide frame standing in the conveyance path in a suitable manner from the conveyance path so that the stack of products can be driven into the tape guide frame along its conveyance path.

In addition to various hinged versions, a particularly suitable configuration of the tape guide frame for these duct portions which are to be removed is known from DE 195 03 112 A1 and from European patent EP 0 725 005 B1 belonging to the Applicant, in which the tape guide duct portions standing in the conveyance path are simply omitted. The strapping tape is shot via these resultant free air gaps. Parallel to the longitudinal direction, the tape is guided into a duct portion corresponding to the upper horizontal web of the tape guide frame and is then shot on down again via the free air gap.

A particular problem with the strapping, in particular of stacks of periodicals, is that the individual copies in the stack only rest on one another prior to strapping of the stack, and slipping and a breakdown of the stack is prevented only by the friction between them. Therefore, the introduction of the unstrapped stack has to be carried out very cautiously and carefully using the conveyors integrated in the work table.

SUMMARY OF THE INVENTION

Starting from this problem, the object of the invention is to develop a strapping machine in such a way that reliable and clean conveyance of the stack of products is guaranteed, in particular in the not yet strapped state.

This object is achieved in that the conveyor used to advance the stack of products is provided with guide walls which flank the stack of products on both sides in the conveyance direction and resemble conveyor belts and with respective feed plates mounted thereon. The guide walls hold and guide the stack of products during conveyance and, at the same time, assist its forward movement. The stack is actually propelled by the feed plates which are mounted on the guide walls and act on the face of the stack directed against the direction of conveyance.

In combination with the special strapping device without guide duct portions standing in the conveyance path of the stack of products, a cleanly defined conveyance path of the stack of products through the strapping machine is obtained with which no tape duct portions which have to be driven laterally out of the conveyance path and therefore come into contact with the lateral guide walls have to be provided.

The controller for the defined control of the conveyor with respect to the speed of the guide walls and position of the feed plates is particularly advantageous in this connection. The term "defined control" means that the position of the feed plates and the speed of the guide walls are monitored throughout operation of the conveyor. The conveyor can therefore be operated continuously so the stack of products can be handled optimally. For example, a virtually "flying exchange" of the stack of products into the conveyor of the strapping machine can take place during the transfer of the stack of products from a delivery device of a component positioned before the strapping machine according to the invention, for example a packaging line. The speed of the guide walls can be adapted to the entry speed of the stack of products. Simultaneous control can be carried out in such a way that the feed plates virtually "catch up with" the stack of products from the entry side and approach the stack of products gently from behind. Therefore, the stack of products does not suffer any impacts as a result of impinging against stationary guide or stop elements in the entry region of the strapping machine.

Package stops which define the strapping position for the stack of products in the machine are also provided in stacking machines. A gentle approach can also be guaranteed by means of the conveyor according to the invention in conjunction with these machine elements. The feed plates simultaneously act as rebound preventers and prevent the elements of the stack from shooting back owing to the package stop.

Although considerably improved handling of the stack of products in the strapping machine can be obtained by the conveyor specified above, some products that are to be strapped nevertheless pose some problems. These are in particular rather irregular stacks of periodicals that exhibit an extremely inhomogeneous structure of the individual periodical and thus of the entire stack due to leaflets of varying format and thickness being inserted. When these periodicals are piled up, the stack very often spreads out so that it is fit for subsequent looping only to a limited extent. In particular, the edges of the periodicals that stand out are doubled up or crushed in these stacks, which negatively affects the clean appearance of the paper.

For this problem to be solved, a preferred embodiment provides that the conveyor-belt-type guide walls that flank the stack of products are mounted on the machine for displacement crosswise of the conveyance direction and can be set moving transversely to the stack of products by driving means. This transverse motion may be in particular a transverse upsetting motion i.e., the two guide walls are moved towards each other, pressing the stack of products together.

As a result of this further development of the strapping machine, the spread out individual periodicals of the stack are shoved together for impeccable looping of the cleanly layered stack to take place subsequently.

The transverse motion of the guide walls may as well be used for transverse displacement of the stack of periodicals so that two strapping jobs may take place in parallel and chronologically out-of-line in the strapping device. This is of advantage in particular for the stacks classified as posing problems.

In keeping with further preferred embodiments, the driving means can set the entire conveyor-belt-type guide walls of the conveyor in oscillating, transverse upsetting motion, to which end the return rollers for the guide walls or a support therefor are displaceably mounted and the driving means engage therewith. The driving means may preferably be a pneumatic cylinder.

An alternative of this configuration resides in that the inward strand, applicable to the stack of products, of the conveyor belt that constitutes the respective guide wall is actuated by an eccentric rotor so that the guide wall itself is set in vibration crosswise of its plane of expanse, causing the crosswise upsetting.

Preferred embodiments of the subject of the invention can be inferred from the accompanying drawings.

DESCRIPTION OF THE PREFERRED EMBODIMENTS

Figure 1:
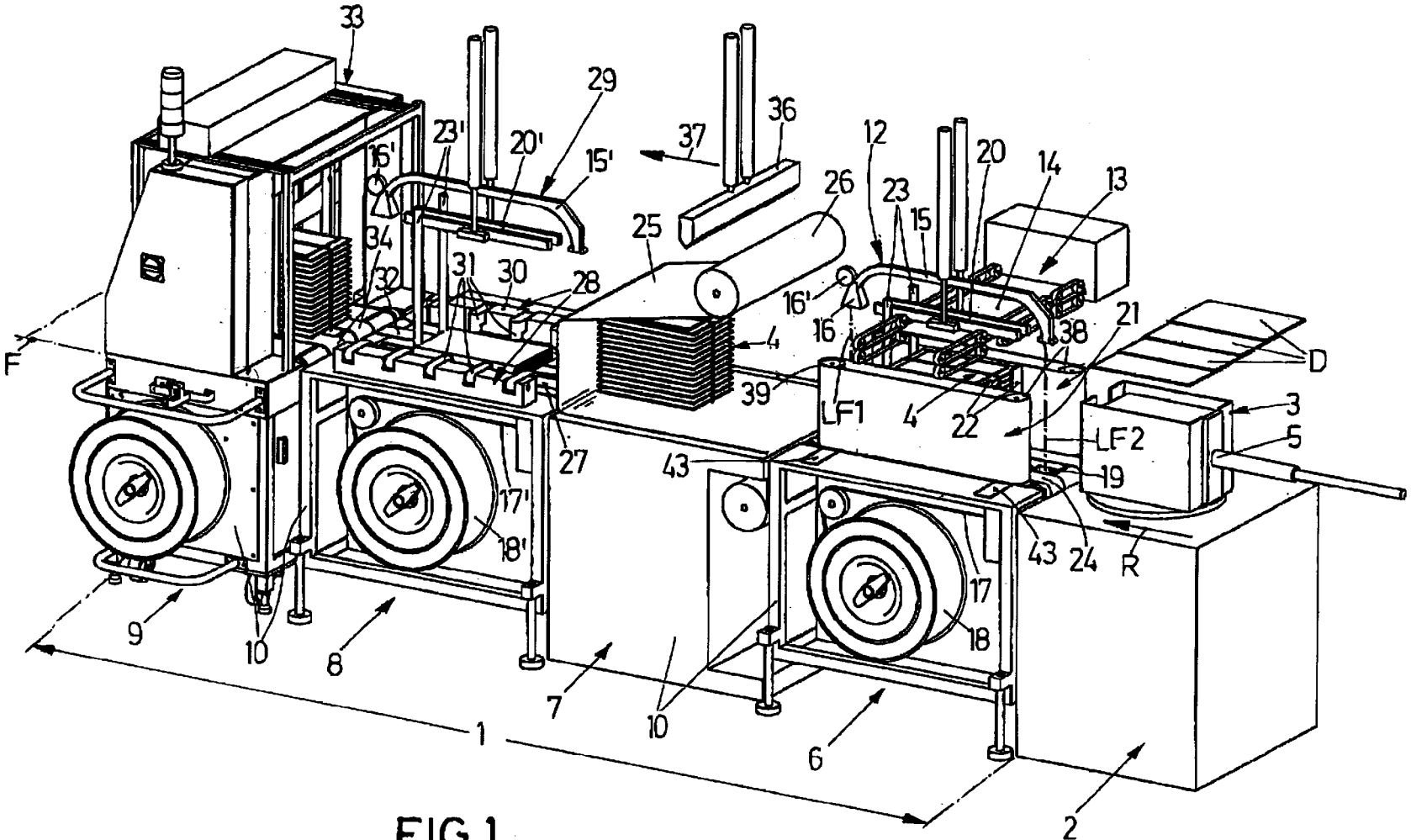
FIG. 1 is a perspective view of a packaging line with a strapping machine according to the invention.
Figure 2:
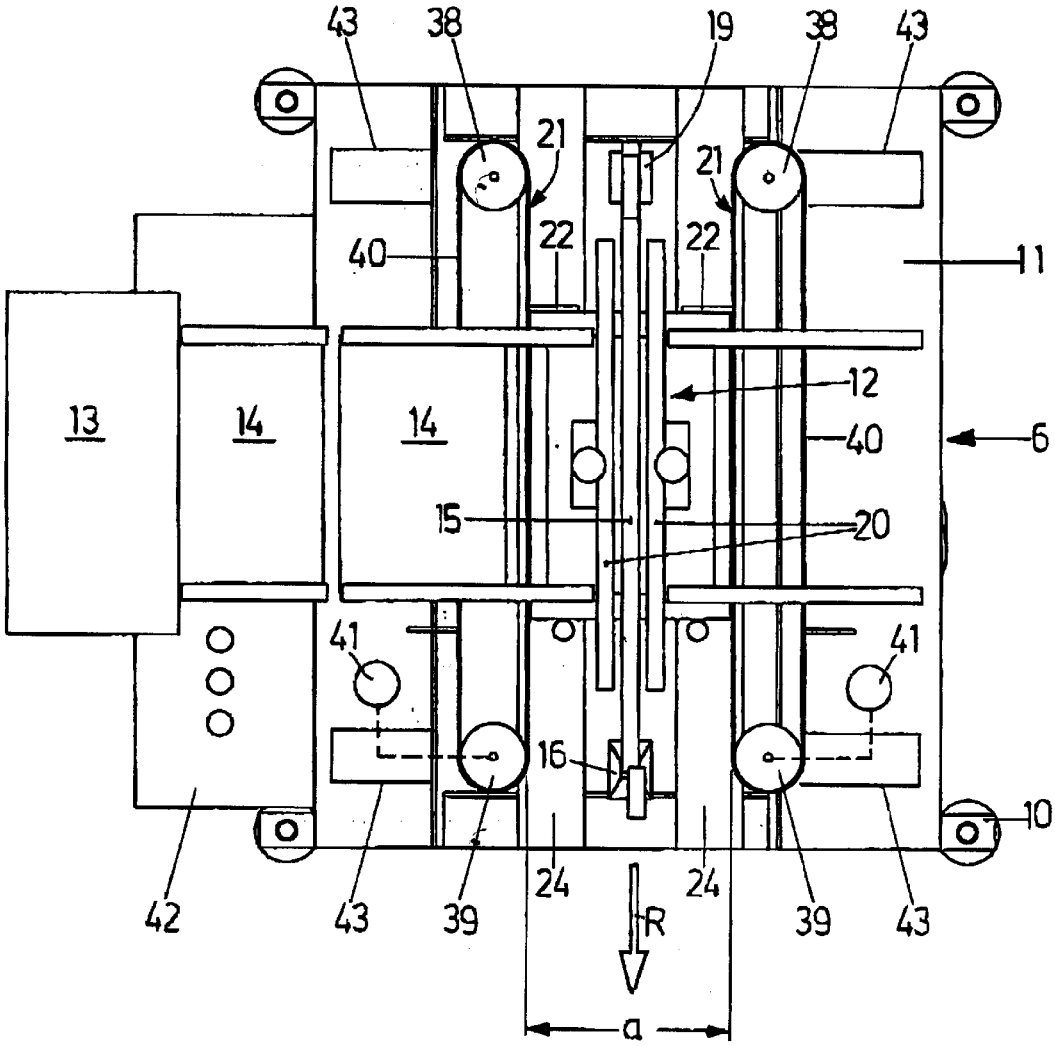
FIG. 2 is a plan view of the strapping machine according to FIG. 1.

As seen in FIGS. 1 and 2, the packaging line designated as a whole by 1 adjoins the compensating stacker 2 of a printing line. A specific number of printed products with a first orientation of the binding edge is inserted into the compensating stacker 2 in a known manner, whereupon the compensating stacker 2 is rotated through 180° about a vertical axis and the specific number of printed products is again inserted in the same orientation of the binding edge. A stack of products is therefore formed in which partial stacks have an opposing orientation of the binding edge. A straight stack of cleanly layered printed products is thus created. As soon as a specific number of printed products is collected in the basket 3 of the compensating stacker 2, the basket is opened and the stack 4 is fed to the packaging line 1 by a delivery slider 5. The packaging line 1 comprises four combined components 6, 7, 8, 9 which will be described in more detail hereinafter. The components 6, 7, 8, 9 have the common feature that they comprise table- or cupboard-like bases 10 which form a work surface 11 with their upper faces. The upper faces are in turn arranged in a common conveying plane F for the stack of periodicals 4.

The combined component 6 which directly adjoins the compensating stacker 2 combines a first strapping device 12 and a top sheet feeder 13 which places a top sheet 14 from the side onto the stack 4 which has been driven into the first component 6. The top sheet feeder 13 is of conventional design and, therefore, needs no further explanation.

The first strapping device 12 is of a type which has no tape duct portions projecting upwardly from the work surface 11. Therefore, there is also shown in FIG. 1, spaced above the work surface 11, only one guide duct portion 15 with a collecting device 16 for the strapping tape 17. This collecting device is provided with an intermediate drive 16' as a band driving device for the band. The mode of operation and construction of this type of strapping device is described comprehensively and in detail in German Offenlegungsschrift DE 195 03 112 A1 and European patent EP 0 725 005 B1. Therefore, it will only be pointed out briefly here that the strapping tape 17 is conveyed from a tape supply reel 18 into a temporary store, not shown. During a strapping process, the tape is shot from there via a first free air gap LF1 between the work surface 11 and the collecting device 16, is taken up by the collecting device 16 and conveyed on in the guide duct portion 15 with the aid of the intermediate drive 16', issues again at the opposite end of the guide duct portion 15 and is shot down into a second collecting device 19 via the second free air gap LF2. In a welding head below the work surface 11, after tightening of the strapping tape placed slackly round the stack 4, the loop of tape is closed and severed from the entering supply of tape.

After application of the top sheet 14, the two clamping bars 20 are also pressed onto the stack 4 from above in order to keep it compact during the subsequent strapping process.

The two lateral guide and conveying walls 21 which are designed in the manner of an endless conveyor belt and are provided with feed plates 22 are also used on the one side for handling the stack 4 in the first combined component 6. These feed plates 22 enter behind the stack 4 maneuvered onto the work surface 11 by the delivery slider 5 of the compensating stacker 2 and push it against the package stop 23 which can be driven in laterally. The not yet strapped stack is guided cleanly by the lateral guide walls 21, the feed plates 22 and the package stop 23 and cannot fall over during this feed motion.

Each guide wall 21 comprises, on the inlet and outlet side with respect to the work surface 11, return rollers 38, 39 which are rotatable round a vertical axis and of which the rollers 39 leading in the conveyance direction R are driven with control by a motor 41. A respective endless belt 40 on which respective single, plate-shaped feed plates 22 are placed is drawn over these return rollers 38, 39. The endless belts 40 and feed plates 22 are positioned and driven with control in such a way that they are driven Synchronously—in other words, at the same longitudinal position—in each handling stage of the conveyor. Motor 41 and controller 42 are indicated schematically by broken rectangles in the manner of a block diagram in FIG. 2. The properties of the controller 42 with respect to the driving of the guide walls 21 and therefore of the feed plates 22 have already been discussed in detail in the introduction of the description so do not need further explanation here.

The return rollers 38, 39 are also mounted on a transverse adjusting device 43 by means of which the two guide walls 21 are mounted with their lateral spacing a on the work table formed by the base 10 and work surface 11. The strapping device can therefore be adapted to various formats of the stack of periodicals 4 by means of this transverse adjusting device 43. Together with the expanse of the guide walls 21 in the conveyance direction R virtually over the entire length 1 of the work surface 11, the stack of periodicals 4 is guided cleanly through the strapping machine 12 throughout its passage.

Figure 3:
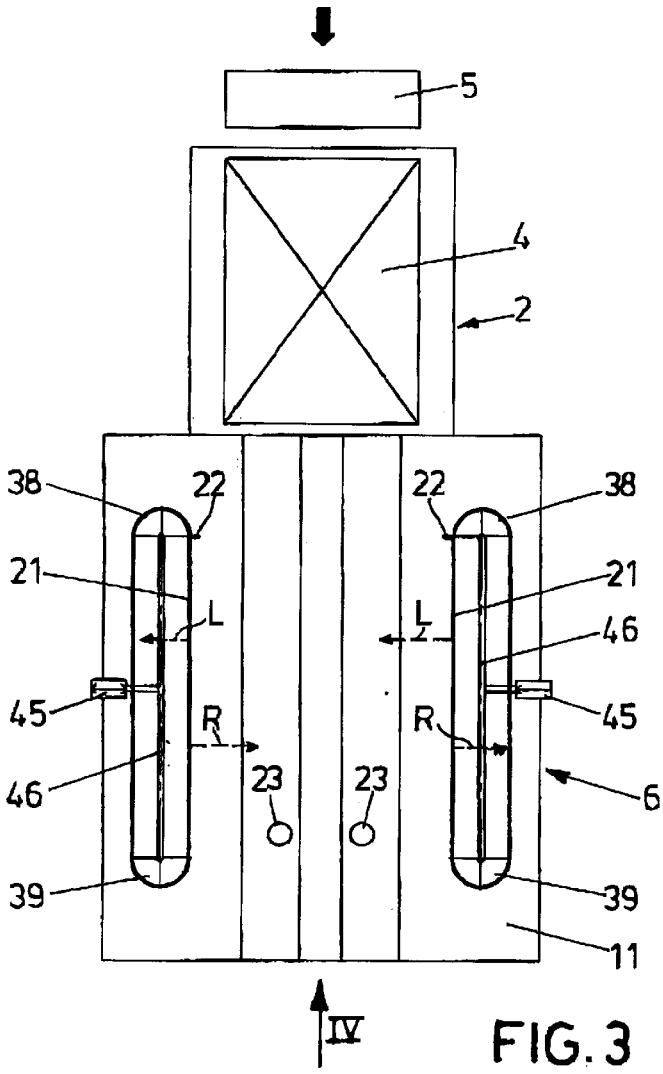
FIG. 3 is a diagrammatic plan view of the strapping machine with an upstream compensating stacker prior to the stack of products entering.
Figure 4:
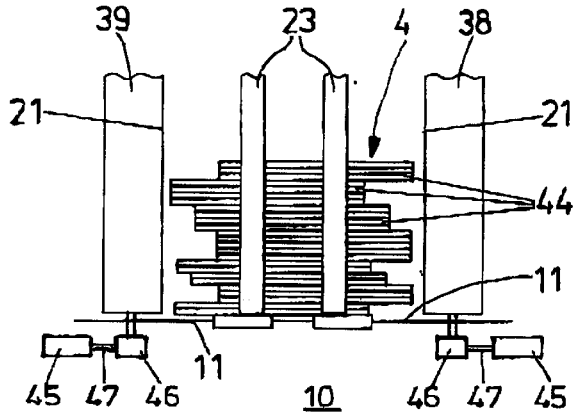
FIG. 4 is a view of the strapping machine from the direction of the arrow IV of FIG. 3.
Figure 5:
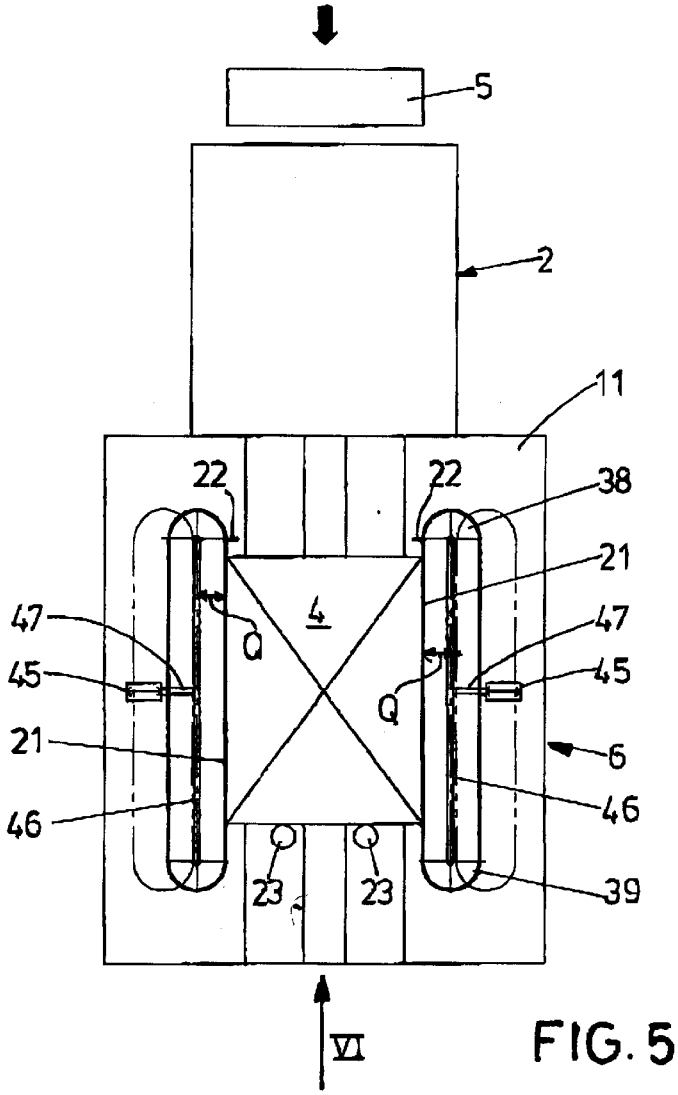
FIG. 5 is a plan view of the strapping machine according to FIG. 3 with the stack of products entered.

As seen in FIGS. 3 to 6, misalignment of individual periodicals 44 may occur in problematic stacks 4 (see FIG. 4). For flush alignment of such a stack 4, it is provided, in addition to the fundamental transverse adjustment by the transverse adjusting device 43, that the conveyor, which comprises the conveyor-belt-type guide walls 21 and the return rollers 38, 39, is equipped with drive means in the form of a pneumatic cylinder 45, by the aid of which the guide walls 21 are set in transverse upsetting motion Q relative to the stack of products 4 roughly outlined by dot-dashed and solid lines in FIGS. 5 and 6, respectively. To achieve this laterally oscillating motion, the two return rollers 38, 39 are mounted on a common support 46 (roughly outlined in FIGS. 3 and 5) which the piston rod 47 of the pneumatic cylinder 45 engages with. The support is guided on guides (not shown) for transverse displacement on the base 10. Alternatively of the pneumatic cylinders 45, other driving means such as electric motors may be employed.

Figure 6:
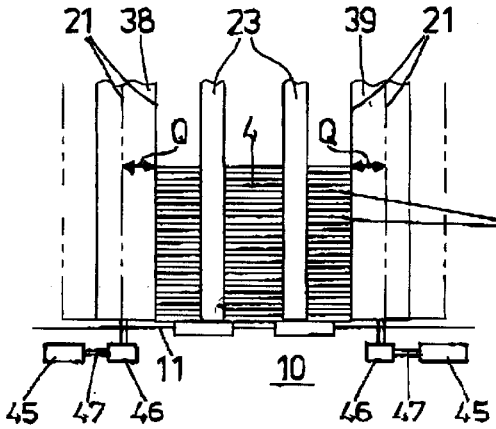
FIG. 6 is a view of the strapping machine from the direction of the arrow VI of FIG. 5.

As becomes apparent from a comparison of FIGS. 4 and 6, the reciprocating transverse upsetting motion Q may now serve to push together the irregular stack 4 (FIG. 4) into a cleanly layered stack 4 (FIG. 6).

Given a correspondingly high lift and rapid operability of the pneumatic cylinder 45, the function of the transverse adjusting device 43 may also be fulfilled by the pneumatic cylinder 45. The width between the two guide walls 21 can thus be suited to the base width of the stack 4 and the degree of irregularity.

When the stack 4 bears against the bars that form the package stop 23 and is upset by the aid of the guide walls 21, lengthwise looping may take place in the first combined component.

As roughly outlined by dashed arrows in FIG. 3, displacement of the stack 4 from the middle to the right (arrows R) may take place by the pneumatic cylinder 45 being triggered correspondingly so that in this position lengthwise strapping may be applied to the left from the middle of the stack 4. Then the two guide walls 21 can be moved back across the middle by the pneumatic cylinders 45 (arrows L in FIG. 3) so that a second lengthwise strapping may be applied that is parallel to the first strapping and misaligned in the cross direction.

Figure 7:
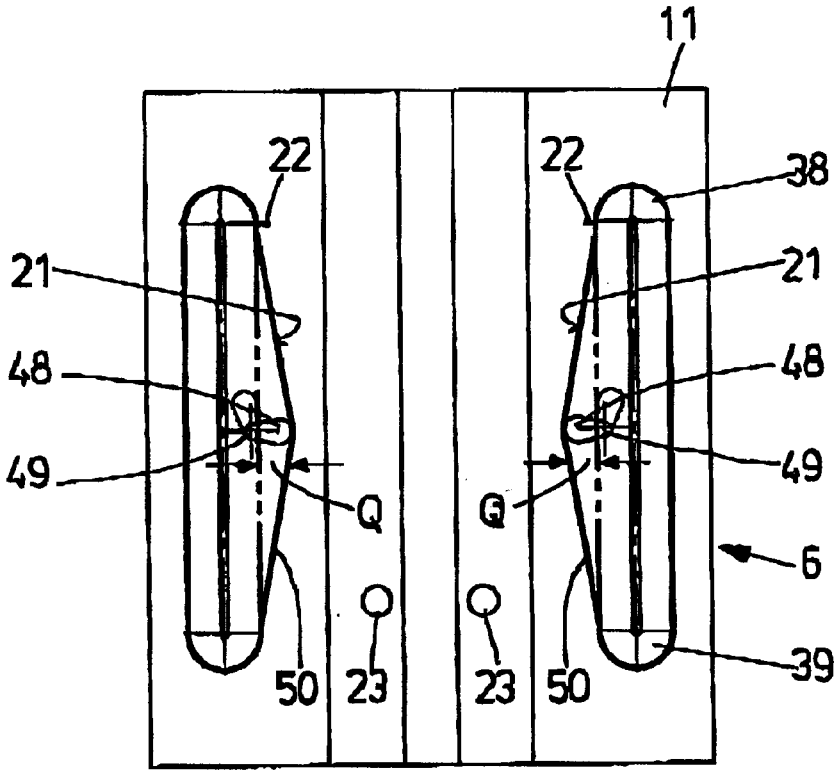
FIG. 7 is a diagrammatic plan view of an alternative embodiment of a strapping machine.

FIG. 7 illustrates an alternative embodiment of the strapping machine in which an upsetting motion Q is produced by cams 48. They are disposed within the conveyor-belt-type guide walls 21 pivotably about a vertical axis 49. The cams 48 act on the inward strand 50, which bears against the stack of products 4, of the guide walls 21, which are flexible and capable of migrating inwardly towards the irregular stack 4. The stack 4 is pushed together and again upset. The cams 48 may also be employed jointly with the first embodiment of the driving means explained in conjunction with FIGS. 3 to 6.

After the first strapping serving merely as auxiliary strapping in the case illustrated and which is a lengthwise strapping in the strapping device 12, the stack 4 is held together and can therefore be conveyed on using conventional conveyor belts in conjunction with the guide walls 21. Therefore, the stack 4 passes from the first combined component 6 through its delivery conveyor belts 24 which is synchronized with the second combined component 7—a film wrapping device—in such a way that the movement of the delivery conveyor belt 24 simultaneously serves to insert the stack 4 into the second combined component 7.

The second combined component 7 has a conventional and known mode of Operation and does not require further explanation it should merely be stated that the stack 4 travels toward a "curtain" of the packaging film 25 which can therefore be brought beneath, in front of, on and, by a corresponding process involving the upper supply roll 26 for the packaging film 25, also behind the stack 4. The stack 4 is then welded at the back by the welding terminal 36 in the combined component 7. The sides remain open. The welding terminal 36 can travel synchronously with the stack 4 in the direction of the arrow 37 so that it is not necessary to stop in order to weld the stack 4. The tube of film formed round the stack 4 by the packing film 25 can optionally also be welded at the sides, the front and back of the stack 4 then remaining open.

The wrapped stack 4 passes via the conveyor belt 27 of the film wrapping device 7 into the third combined component 8 which combines a lateral welding device 28 with a second strapping device 29. The second strapping device 29 has the same construction and mode of Operation as the first strapping device 12 and so does not require further explanation. Corresponding components are provided with corresponding reference numerals with apostrophes.

The lateral welding device 28 comprises welding terminals 30 with spot welding units 31. Owing to the arrangement of the functional component 8 to the side of the conveyor belts 32, therefore, spot welding takes place there at the sides of the packaging film. This spot welding is carried out only with very small stacks. Higher stacks receive longitudinal strapping by the strapping device 29 after film wrapping in the functional component 7.

A cross-strapping device 33 follows in the last component 9 and is in turn fed on the inlet side by the conveyor belts 34 of the previous functional component 8.

What is claimed is:

1. A strapping machine for strapping a stack of products (4), by means of a strapping tape comprising a worktable (10, 11);

first conveyor means (24), arranged on the work table (10, 11), for entering said stack of products (4) into the strapping machine and for conveying said stack of products (4) in a conveyance direction R of said stack of products (4);

a strapping device (12), arranged on the work table (10, 11), with a tape guide unit (15) which is free from guide duct portions projecting upwardly from a work surface (11) of the work table (10, 11) in a conveyance path of the stack of products (4);

retractable package stop means (23), adapted to stop said stack of products (4) prior to being strapped;

second conveyor means, comprising conveyor-belt-type guide walls (21) which flank the stack of products (4) on both sides in said conveyance direction R and feed plates (22) mounted on said guide walls (21); and a controller (42), allocated to said second conveyor means (21, 22) and having means (41) to control a speed of the guide walls (21) and a position of the feed plates (22) such that the second conveyor means (21, 22) together with said guide walls (21) and feed plates (22) take over the stack of products (4) in a flying manner, and entrap it together with the package stop means (23) prior to strapping.

2. A strapping machine according to claim 1, wherein each guide wall (21) comprises two return rollers (38, 39) which are arranged on the work table (10, 11) on an inlet side and an outlet side and round which an endless belt (40) is placed and at least one of which has a controlled drive (41).

3. A strapping machine according to claim 1, wherein the guide walls (21) are mounted on the work table (10, 11) so as to be adjustable in their lateral spacing (a) from one another.

4. A strapping machine according to claim 3, comprising drive means (45, 48) adapted to move said laterally adjustable guide walls (21) laterally.

5. A strapping machine according to claim 4, wherein the drive means (45, 48) are adapted to set said guide walls (21) in laterally oscillating motion.

6. A strapping machine according to claim 4, wherein two return rollers (38, 39) of a guide wall (21) are disposed on a support (46) which is mounted for transverse displacement and which the drive means (45) engage with.

7. A strapping machine according to claim 4, wherein the drive means are formed by a pneumatic cylinder (45).

8. A strapping machine according to claim 4, wherein each guide wall (21) has two return rollers (38, 39) which are disposed on the work table on the inlet and on the outlet side and have an endless belt (40) placed around them, the drive means being formed by a cam (48) which acts on the inward strand (50), applicable to the stack of products (4), of the guide walls (21).

9. A strapping machine according to claim 4, wherein a transverse adjusting device (43) for the guide walls (21) is formed by the drive means (45).

10. A strapping machine according to claim 1, wherein the strapping machine is a longitudinal strapping device.

11. A strapping machine according to claim 10, wherein the longitudinal strapping device (12) comprises a tape guide duct portion (15) which is arranged above the work surface (11) and extends in the conveying direction (R).

12. A strapping machine according to claim 11, wherein the tape guide duct portion (15) has a belt collecting and feed device (16, 16') on an entry side.

* * * * *